US005252103A

United States Patent [19]

Kamata et al.

[11] Patent Number: 5,252,103

[45] Date of Patent: Oct. 12, 1993

[54] PIGMENTING OF CELLULOSE TEXTILES: TREATMENT WITH CATIONIC COMPOUND AND IMMERSION IN AQUEOUS PIGMENT DISPERSION

[75] Inventors: Masayasu Kamata, Kusatsu; Osamu Sasaki; Shouzou Suefuku, both of Ohtsu; Tatsuya Maeda, Kyoto, all of Japan

[73] Assignee: Matsui Shikiso Chemical Co, Ltd., Kyoto, Japan

[21] Appl. No.: 831,473

[22] Filed: Feb. 5, 1992

[30] Foreign Application Priority Data

Feb. 5, 1991 [JP] Japan ..... 3-36814

[51] Int. Cl.[5] ..... D06P 5/04; D06P 5/20; D06P 5/22

[52] U.S. Cl. ..... 8/554; 8/602; 8/606; 8/637.1; 8/918

[58] Field of Search ..... 8/637.1, 554

[56] References Cited

U.S. PATENT DOCUMENTS 5,131,913 7/1992 Martini ..... 8/448

FOREIGN PATENT DOCUMENTS 2051000 4/1992 Canada .

OTHER PUBLICATIONS

J. Lenoir in Venkataraman's "The Chemistry of Synthetic Dyes", vol. V, (Academic Press), 1971, p. 314.

*Primary Examiner*—A. Lionel Clingman
*Attorney, Agent, or Firm*—McGlew and Tuttle

[57] ABSTRACT

An improved pigmented product is obtained by a pigmenting method comprising the steps of:

treating a cellulose fiber textile product with a cationic compound; and treating the thus-treated textile product by immersing it in a aqueous dispersion containing a pigment and an anionic compound.

17 Claims, No Drawings

PIGMENTING OF CELLULOSE TEXTILES: TREATMENT WITH CATIONIC COMPOUND AND IMMERSION IN AQUEOUS PIGMENT DISPERSION

CROSS-REFERENCE TO RELATED APPLICATIONS

This application is related to applicants' copending applications Ser. No. 670,747 filed Mar. 15, 1991, entitled DYEING METHOD AND PRODUCT DYED THEREBY, now U.S. Pat. No. 5,221,288, and Ser. No. 775,146 filed Oct. 8, 1991, entitled DYEING METHOD AND DYED PRODUCT, which is a continuation in part of said Ser. No. 670,747.

BACKGROUND OF THE INVENTION

1. Field of the Invention

The present invention relates to a method of pigmented cellulose fiber textile product with an ordinary organic or inorganic pigment or daylight fluorescent pigment.

2. Description of the Prior Art

Usually, none of the ordinary organic or inorganic pigments or daylight fluorescent pigments are capable of directly pigmenting fiber because of a lack of affinity with fiber. Although physical coloring is possible by the synthetic resin printing method, the synthetic resin padding method and other methods using an adhesive such as synthetic resin binder, it is difficult to obtain a high density coloring while maintaining the fiber texture and appearance of the colored product.

For example, in the case of the synthetic resin printing method, a high coloring density is obtained when bulky printing is conducted on a textile product using an ink containing a pigment and a synthetic resin binder at high concentrations. In this case, the surface of the textile product loses its fiber texture, its appearance worsens, and its color fastness to rubbing and color fastness to washing are insufficient. For these reasons, even when the entire surface of the cloth is colored, no commercially valuable product will be obtained.

Also, when using the pigment resin padding method with high concentrations of pigment and synthetic resin binder, the pigment is not capable of being thoroughly adsorbed and coloring the textile with high color density because of a lack of substantivity with fiber. Moreover, the obtained fiber texture, appearance, color fastness to rubbing, and other properties are insufficient, and a gumming up of the synthetic resin binder is apt to happen.

SUMMARY OF THE INVENTION

It it an object of the present invention to provide a pigmenting method which permits pigmenting of a cellulose fiber textile product while pigment to high densities with maintaining the fiber texture and appearance of the pigmented product, and which provides the pigmented product with good color fastness to rubbing and good color fastness to washing.

The object described above can be accomplished by the pigmenting method of the present invention, which comprises the steps of:

treating a cellulose fiber textile product with a nitrogenous cationic compound; and treating the thus-treated textile product by immersing it in an aqueous dispersion containing a pigment and an anionic compound.

The various features of novelty which characterize the invention are pointed out with particularity in the claims annexed to and forming a part of this disclosure. For a better understanding of the invention, its operating advantages and specific objects attained by its uses, reference is made to the accompanying descriptive matter in which preferred embodiments of the invention are illustrated.

DETAILED DESCRIPTION OF THE INVENTION

Cellulose Fiber

Examples of the cellulose fiber for the present invention include natural fibers such as cotton and hemp and regenerated fibers such as rayon and cupra.

Cellulose Fiber Textile Product

Examples of the cellulose fiber textile product described above include cellulose fiber Yarns, blended yarns of cellulose fiber with polyester fiber, acrylic fiber, wool, etc., or fabrics or knits comprising cellulose fiber yarn and/or the blended yarn described above, cellulose-containing nonwoven fabrics, and sewn products such as apparels based on these fabrics, knits or nonwoven fabrics. Examples of sewn products are T-shirt, trainer, dress shirt, sport shirt, jumper, jeans, pants, socks, gloves, mittens, cap, hat, bag and so on.

The textile product for the present invention may be colored in advance.

The term "alkyl" as used herein includes aliphatic chains having up to 20 carbon atoms.

Cationic Compound

Examples of the nitrogenous cationic compound described above include quaternary ammonium salt type compounds,
pyridinium salt type compounds,
dicyandiamide type compounds,
polyamine type compounds, and
polycation type compounds.

Specific examples of the cationic compounds are as follows.

Examples of the quaternary ammonium salt type compounds include
quaternary ammonium salt type cationic surfactants, especially the halides, and particularly the chlorides, such as
trimethyloctadecylammonium chloride,
trimethyloctadecylammonium chloride,
trimethyllaurylammonium chloride,
dimethyllaurylammoniumchloride,
laurylmethylammonium chloride,
stearyltrimethylammonium chloride,
lauryldimethylbenzylammonium chloride,
lauryltrimethylammonium chloride,
alkylbenzyldimethylammonium chloride,
stearylbenzyldimethylammonium chloride, and
alkyltrimethylammOnium chloride;
pyridinium salt type surfactant such as laurylpyridinium chloride, and stearylamide methylpyridinium chloride;
2,3-epoxypropyltrimethylammonium chloride;
3-chloro-2-hydroxypropyltrimethylammonium chloride;

quaternary ammonium salt compounds having a triazine ring, e.g. as disclosed in Unexamined Japanese Patent Publication Nos. 155285/1977 and 155286/1977,
2-hydroxy-3-methacryloxypropyltrimethylammonium chloride,
2-methacryloxyethyltrimethylammonium chloride,
2-methacryloxyethyltrimethylammonium metasulfate,
p-vinyl-benzyltrimethylammonium chloride,
(meth)acrylamidoethyldiethylammonium metasulfate,
(meth)acrylamidopropyldimethylhydroxyethylammonium chloride,
(meth)acrylamidoethyldiethylglycidylammonium chloride,
(meth)acrylamidopropyldimethylallylammonium chloride,
(meth)acrylamidoethyldiethylmethoxymethylammonium chloride,
2-heptadecyl-1-ethyl-[(2-octadecanoylamino)ethyl-]imidazoliniumethyl sulfate,
2-heptadecyl-1-methyl-1-[(2-hexadecanoylamino)ethyl-]imidazoliniumethyl sulfate, and 1,3-bis(3-chloro-2-hydroxypropyl)imidazolinium dichloride.

Examples of the dicyandiamide type compounds include the formalin condensation products of dicyandiamide.

Examples of the polyamine type compounds include the guanidine derivative condensation products of
polyalkylenepolyamine;
polyethyleneimines, and
polyamidepolyamines.

Examples of the polycation type compounds include
poly-4-vinylpyridine hydrochloride;
tertiary amine polymers such as polyacrylonitrile polymers, e.g. as disclosed in Unexamined Japanese Patent Publication No. 64186/1979;
the polymers of the quaternary ammonium salts such as
2-hydroxy-3-methacryloxypropyltrimethylammonium chloride,
2-methacryloxyethyltrimethylammonium chloride,
2-methacryloxyethyltrimethylammonium metasulfate,
p-vinyl-benzyltrimethylammonium chloride,
(meth)acrylamidoethyldiethylammonium metasulfate,
(meth)acrylamidopropyldimethylhydroxyethylammonium chloride,
(meth)acrylamidoethyldiethylglycidylammonium chloride,
(meth)acrylamidopropyldimethylallylammonium chloride, and
(meth)acrylamidoethyldiethylmethoxymethylammonium chloride; and
copolymers of the quaternary ammonium salts described above and other vinyl monomers.

Of these cationic compounds, polyamine type compounds; dicyandiamide type compounds; and polycation type compounds of quaternary ammonium salt polymers and copolymers of quaternary ammonium salts and other vinyl monomers are particularly effective on the present invention.

Pigmenting of a cellulose fiber textile product by the pigmenting method of the present invention can be achieved for example as follows:

The textile product described above is first scoured, i.e. scrubbed vigorously, to remove sizing and impurities. Scouring is of course unnecessary when the textile product is clean.

Next, to an appropriate pigmenting bath vat, water in a weight amount 5 to 50 times the weight amount of the textile product (bath ratio=5:1 to 50:1), preferably 10 to 30 times (bath ratio=10:1 to 30:1), is added, and a cationic compound is added thereto in a ratio of about 0.1 to 20% by weight, preferably about 0.3 to 5% by weight, relative to the non-treated textile product.

An acid such as acetic, tartaric, oxalic or malic acid may be added to adjust the pH to the acidic side, or a wetting agent such as urea, glycerol, ethylene glycol, polyethylene glycol or diethylene glycol may be added to improve the permeability of the cationic compound into the textile product.

Next, the textile product described above is immersed in the aqueous solution thus obtained, and the temperature is maintained at normal temperature to about 80° C. for about 5 to 30 minutes, preferably the temperature is gradually increased up to about 50 to 80° C. and this temperature is maintained for about 5 to 30 minutes, whereby the cellulose fiber of the textile product is efficiently cationized, i.e. it is cationically modified to render its surface receptive to adsorption and adherence of the fine particles of the pigment.

Subsequently, this textile product is thoroughly rinsed to wash down the excess portion of the cationic compound and other additives, and then dehydrated, i.e. squeezed to damp condition.

Next, to the meanwhile emptied vat containing the thus treated textile product, water is added in a weight ratio of about 5:1 to 50:1, preferably 10:1 to 30:1, relative to the non-treated textile product, and the pigment is added and dispersed in a ratio of about 0.1 to 20% by weight, preferably 0.5 to 10% by weight, relative to the non-treated textile product.

An anionic compound is used in order to disperse the pigment in the water. The preferable diameter of the dispersed pigment is 0.05 to 10 μm. The pigment is preferably added to the water in the form of an aqueous dispersion liquid containing a dispersion of a pigment dispersed with an anionic compound.

Examples of the anionic compounds include anionic surfactants and anionic polymer compounds.

These anionic compounds are used in a ratio of about 0.1 to 100% by weight, preferably 1 to 50% by weight, relative to the pigment.

The aqueous dispersion liquid thus obtained is treated at normal temperature to about 90° C. for about 5 to 30 minutes, whereby the pigment is almost completely exhausted into the cationized textile product described above, in that the dispersed pigment is taken up by the textile product so that essentially almost no pigment is left in the liquid remaining in the vat. This treating temperature is preferably about 60 to 90° C. when using the pigment in a ratio of 1 to 20% by weight relative to the non-treated textile product.

This treatment results in the binding of the pigment to the textile product described above by chemical ion bonding and physical adsorption. This product is then dehydrated (squeezed damp) and dried at normal temperature, and heated at preferably about 80 to 180° C. for about 0.5 to 10 minutes, whereby the pigment is firmly fixed to the textile product.

The textile product thus obtained has been pigmented with the pigment to a high color density and, in addition, it maintains a good texture and appearance, and it is excellent in color fastness to rubbing and color fastness to washing.

Examples of the anionic surfactants described above include
fatty-acid hard soaps,
fatty-acid soft soaps, alkyl sulfates,
triethanolamine laurylsulfate,
higher alcohol sulfates,
alkyl sulfuric ester salts,
alkyl benzene sulfonates,
alkyl naphthalene sulfonates,
dialkyl sulfosuccinates,
alkyl diphenyl ether disulfonates,
alkyl phosphates,
polyoxyethylene alkyl sulfates,
polyoxyethylene alkylaryl sulfates,
polyoxyethylene alkyl ether sulfates,
polyoxyethylene alkylphenyl ether sulfates,
polyoxyethylene polystyrylphenyl ether sulfate,
sodium salt of formaldehyde condensation product of aromatic sulfonic acid, and
polyethylene alkyl phosphates.

Examples of the anionic polymer compounds described above include
polyacrylic acids,
poly-α-hydroxyacrylic acid,
polymethacrylic acids,
copolymers of these substances with other vinyl polymers,
ethylene/maleic anhydride copolymer,
butylene/maleic anhydride copolymer,
vinyl ether/maleic anhydride copolymer,
anion-modified polyvinyl alcohol,
gum arabic,
carboxymethyl cellulose,
hydroxyethyl cellulose,
hydroxypropyl cellulose, and
starch derivatives.

Of these anionic compounds,
alkyl sulfuric ester salts,
alkyl benzene sulfonates,
alkyl naphthalene sulfonates,
alkyl diphenyl ether disulfonates,
polyoxyethylene alkyl sulfates,
polyoxyethylene alkylaryl sulfates,
polyoxyethylene alkyl ether sulfates,
polyoxyethylene alkylphenyl ether sulfates,
polyoxyethylene polystyrylphenyl ether sulfate,
butylene/maleic anhydride copolymer,
vinyl ether/maleic anhydride copolymer, and
anion-modified polyvinyl alcohol
are particularly preferable. Using these anionic compounds, the pigment is highly taken up into the cationically treated cellulose fiber textile product.

Examples of the inorganic pigments for the present invention include
zinc yellow,
emerald green,
red lead,
chrome yellow,
cadmium red,
cadmium yellow,
Guignet's green,
ultramarine blue,
cobalt blue,
prussian blue,
titanium dioxide,
titanium yellow,
black iron oxide,
red iron oxide,
molybdenum red, and
carbon black.

Examples of the organic pigments include
Hansa Yellow,
Benzidine Yellow,
Benzidine Orange GG,
Pyrazolone Orange,
insoluble or slightly soluble azo red pigments,
quinacridone red,
dioxazine violet,
condensed azo red pigments,
anthraquinone yellows,
phthalocyanine blue,
Indanthrene Blue,
phthalocyanine green.

Examples of daylight fluorescent pigments include those prepared by coloring a formaldehyde condensation product of cyclic aminotriazine compound or a formaldehyde condensation product of cyclic aminotriazine compound and aromatic monosulfamide compound as the base resin with a fluorescent cation pigment or disperse pigment.

It is preferable to use the ordinary organic or inorganic pigments or daylight fluorescent pigments in the form of an aqueous dispersion liquid containing a dispersion of the pigment having a diameter of 0.05 to 10 μm. This dispersion liquid can be prepared by wet milling of the pigment in a water with the anionic surfactant described above. An nonionic surfactant and the wetting agent described above are added to the water as needed.

Also, in the presence of the above anionic compound as emulsifying agent or dispersing agent (suspending agent), a daylight fluorescent pigment obtained by coloring an aqueous emulsion polymer or suspension polymer of
vinyl chloride,
unsaturated vinyl compound and vinyl chloride, or
unsaturated vinyl compound and acrylonitrile
with a fluorescent cationic pigment or dispersion pigment upon or after polymerization can be used as such, since the grain diameter of the obtained daylight fluorescent pigment can be about 0.05 to 5 μm.

In order to enhance the color fastness to rubbing and color fastness to washing furthermore, a binder can be used in the process of pigmenting the cellulose fiber textile product of the present pigmenting method. As the quantity of the binder to enhance the color fastness is much less than that of the binder heretofore used, the pigmented product can fully maintain its fiber texture and appearance.

The binder can be added to the treatment liquid containing the cationic compound before the textile product is cationically treated with the cationic compound. This treatment temperature is preferably about 50 to 80° C. The textile product is thereafter treated with the binder and cationic compound containing treatment liquid for cationically treating the textile product and for binding the pigment to the textile product upon treating the textile product with the dispersion liquid for pigmenting the product.

The binder can be added to the aqueous dispersion liquid containing the dispersion of the pigment dispersed with the anionic compound before the textile product is pigmented with the pigment. The textile product is thereafter treated with the binder and pigment containing dispersion liquid for pigmenting the product with the pigment and for binding the pigment to the textile product by the binder. This treatment temperature is preferably normal temperature to about 90° C. The treated textile product is thereafter washed as need be, and dehydrated and dried. To the thus obtained textile product, the pigment is strongly fixed.

The binder can be added to the residual dispersion liquid after the textile product has been pigmented with the pigment. The pigmented textile product is thereafter treated with the binder containing dispersion liquid.

The textile product can be treated with the binder in the form of a mixture thereof with water, after the textile product has been pigmented with the pigment.

For example, after the the textile product has been pigmented with the pigment, to the emptied vat containing the dehydrated textile product, water is added in a weight ratio of about 5:1 to 50:1, preferably 10:1 to 30:1, relative to the non-treated textile product, and the binder is added, followed by treatment preferably at normal temperature to about 90° C. for 5 to 30 minutes, and dehydration and drying. To the thus obtained textile product, the pigment is strongly fixed.

Examples of the above described binder include
acrylic ester resin
polyurethane resin,
polyester resin,
styrene-butadiene latex,
chlorinated polyolefin resin,
polyacrylic acid,
methacrylic acid,
their derivatives, and
copolymers of these substances with other vinyl polymers.

For the present invention, acrylic ester resin and polyurethane resin are especially preferably.

The binder solid content is preferably 0.1 to 10% by weight to the textile product. This amount is insufficient to detract from the favorable appearance and touch (feel) of the dyed product. The binder solid content is more preferably less than 5% by weight thereof.

Furthermore, it is also possible to color the textile product in advance with a direct dye, an acid dye or other dyes, and subject it to any one mode of the pigmenting method of the present invention described above.

By the combined use of the pigment and a thermochromic and/or photochromic material in the present invention, the color of the pigmented product shows reversible color changes by changing temperature or in the presence or absence of light irradiation.

Examples of the thermochromic material available for the present invention include a microcapsule of 1-10 μm in diameter which contains a three-component mixture of acid developing substance, acidic substance and solvent, or a liquid crystal.

Examples of the photochromic material available for the present invention include
a microcapsule of 1-10 μm in diameter which contains an organic photochromic compound, and
a particle which contains dispersed photochromic material in a matrix of synthetic resin, Examples of the preferable capsule-wall materials include one or more kinds of the following high polymer compounds:
polyurea,
polyamide,
polyester,
polyurethane,
epoxy resin,
urea resin,
melamine resin,
gelatin,
ethyl cellulose,
polystyrene, and
polyvinyl acetate.

The following examples are set forth by way of illustration and not limitation of the invention. All parts and % referred to therein are parts by weight and percent by weight respectively unless specifically stated otherwise.

EXAMPLES

EXAMPLE 1

A cotton T-shirt (grey sheeting, 120 parts) was washed with water (bath ratio=20:1) containing a detergent (nonionic surfactant) in a drum dyeing machine. This T-shirt was thoroughly rinsed with water and dehydrated.

Next, the T-shirt was immersed in the aqueous solution of 3000 parts of water and 1.5 parts of HISET C-721 [trade name, copolymer of acrylic amide and 2-methacryloxyethyltrimethylammonium chloride (cationic compound), product of Daiich Kogyo Seiyaku Co., ], and the solution was gradually heated to 60° C., at which temperature it was treated for 15 minutes. Subsequently, the T-shirt was thoroughly rinsed with water, and dehydrated.

Next, the T-shirt was immersed in the mixture liquid (aqueous dispersion liquid) of 3000 parts of water (bath ratio=25:1) and 18 parts of the aqueous dispersion liquid of organic green pigment having 0.1 μm average particle diameter [20% of phthalocyanine green, 2% of HAITENOL No. 7 {trade name, ammonium salt of polyoxy alkyl ether sulfonic acid (anionic surfactant), product of Daiich Kogyo Seiyaku Co.} and 78% of water], and it was treated at 70° C. for 15 minutes.

After treatment, this T-shirt was thoroughly rinsed with water and dehydrated, after which it was subjected to tumbler drying at 130° C. for 3 minutes.

The obtained T-shirt was found to be totally deep green. The appearance, handling touch, color fastness to rubbing and color fastness to washing of the T-shirt were all good.

EXAMPLE 2

A cotton T-shirt (grey sheeting, 120 parts) was washed and cationized in the same manner as in Example 1. Subsequently, the T-shirt was thoroughly rinsed with water, and dehydrated.

Next, the T-shirt was immersed in the mixture liquid (aqueous dispersion liquid) of 3000 parts of water (bath ratio=25:1) and 24 parts of the aqueous dispersion liquid of daylight fluorescent pink pigment having 2 μm average particle diameter [30% of formaldehyde condensation product of cyclic aminotriazine compound and aromatic monosulfamide compound dyed with cation dye, 2% of HAITENOL No. 7 (aforesaid), 8% of urea and 60% of water], and it was treated at 70° C. for 15 minutes.

After the treatment, this T-shirt was thoroughly rinsed with water and dehydrated, after which it was subjected to tumbler drying at 130° C. for 3 minutes.

The obtained T-shirt was found to be totally deep and vivid daylight fluorescent pink. The appearance, handling touch, color fastness to rubbing and color fastness to washing of the T-shirt were all good.

COMPARATIVE EXAMPLE 1

A cotton T-shirt (grey sheeting, 120 parts) was washed in the same manner as in Example 1, Subsequently, the T-shirt was thoroughly rinsed with water, and dehydrated.

Next, the T-shirt was immersed in a padding solution consisting of 3000 parts of water (bath ratio=25:1), 180 parts of the aqueous dispersion liquid of organic green pigment as used in Example 1 and 240 parts (solid content= about 72 parts) of MATSUMINSOL MR-10 (trade name, acrylic ester resin binder, product of Matsui Shikiso Chemical Co., Ltd.) by the two-dip two-nip method and then dehydrated, and subjected to tumbler drying at 130° C. for 3 minutes.

The obtained T-shirt was found to be totally green. But the color density thereof was about 30% relative to the T-shirt of Example 1. The appearance and handling touch of the T-shirt were spoiled.

COMPARATIVE EXAMPLE 2

A cotton T-shirt was treated in the same manner as in Example 1 except that EMULGEN 120 [trade name, polyoxyethylene alkyl phenyl ether (nonionic surfactant), product of Kao Co.] was used in place of the anionic surfactant (HAITENOL No. 7).

The obtained T-shirt was totally green. But the color density thereof was about 30% relative to the T-shirt of Example 1.

COMPARATIVE EXAMPLE 3

A cotton T-shirt was treated in the same manner as in Example 1 except that 1% of the anionic surfactant (HAITENOL No. 7) and 1% of the nonionic surfactant (EMULGEN 120) as in used in Comparative Example 2 were used in place of 2% of the anionic surfactant (HAITENOL No. 7).

The obtained T-shirt was totally green. But the color density thereof was about 50% relative to the T-shirt of Example 1.

EXAMPLE 3

Cotton jeans (500 parts) were washed with water (bath ratio=25:1) containing a detergent (nonionic surfactant) in a drum dyeing machine. The jeans were thoroughly rinsed with water and dehydrated.

Next, the jeans were immersed in the aqueous solution of 10000 parts of water (bath ratio=20:1) and 6 parts of polymer of methacrylamidopropylidimethylallylammonium chloride, and the solution was treated for 15 minutes at 60° C. Subsequently, the jeans were thoroughly rinsed with water, and dehydrated.

Next, the jeans were immersed in the mixture liquid (aqueous dispersion liquid) of 10000 parts of water (bath ratio=20:1), 15 parts of the aqueous dispersion liquid of organic blue pigment having 0.2 μm average particle diameter [25% of phthalocyanine blue, 5% of sodium salt of alkyl sulfuric ester (anionic surfactant), 5% of propylene glycol and 65% of water], and 40 parts (solid content=about 15 parts) of HYDRAN HW-111 [trade name, water soluble polyurethane resin, product of Dainippon Ink and Chemicals, Inc.], and it was treated at 70° C. for 15 minutes.

After the treatment, this jeans were thoroughly rinsed with water and dehydrated, after which it was subjected to tumbler drying at 130° C. for 3 minutes.

The obtained jeans were found to be totally deep blue. The appearance, handling touch, color fastness to rubbing and color fastness to washing of the jeans were all good.

EXAMPLE 4

Cotton jeans (500 parts) were washed in the same manner as in Example 3. The jeans were thoroughly rinsed with water and dehydrated.

Next, the jeans were immersed in the aqueous solution of 10000 parts of water, 6 parts of polymer of methacrylamidopropylidimethylallylammonium chloride, and 40 parts of HYDRAN HW-111 (aforesaid), the solution was treated for 15 minutes at 60° C. Subsequently, the jeans were thoroughly rinsed with water, and dehydrated.

Next, the jeans were immersed in the mixture liquid (aqueous dispersion liquid) of 10000 parts of water and 15 parts of the aqueous dispersion liquid of organic blue pigment as in used in Example 3, and it was treated at 70° C. for 15 minutes.

After the treatment, this jeans were thoroughly rinsed with water and dehydrated, after which it was subjected to tumbler drying at 130° C. for 3 minutes.

The obtained jeans were found to be totally deep blue. The appearance, handling touch, color fastness to rubbing and color fastness to washing of the jeans were all good.

EXAMPLE 5

A cotton T-shirt (smooth knit, 150 parts) was washed, thoroughly rinsed with water, and dehydrated.

Next, the T-shirt was immersed in the aqueous solution consisting of 3000 parts of water and 5 parts of SANFIX 70 (trade name, dicyandiamide type cationic polymer compound, product of Sanyo Kasei Kogyo Co.), and it was treated at normal temperature (25° C.) for 20 minutes. After the treatment, this T-shirt was thoroughly rinsed with water and dehydrated.

Next, the T-shirt was immersed in the mixture liquid (aqueous dispersion liquid) of 3000 parts of water and 24 parts of the aqueous dispersion liquid of daylight fluorescent yellow pigment having 2 μm average particle diameter [30% of formaldehyde condensation product of cyclic aminotriazine compound and aromatic monosulfamide compound dyed with disperse dye, 2% of NEOPELEX FS (trade name, sodium dodecylbenzenesulfonate {anionic surfactant}, product of Kao Co.), 8% of propylene glycol and 60% of water], and it was treated at normal temperature (25° C.) for 20 minutes. After the treatment, this T-shirt was thoroughly rinsed with water and dehydrated.

The T-shirt was immersed in the mixture liquid of 3000 parts of water and 15 parts (solid content=about 4.5 parts) of MATSUMINSOL MR-10 (aforesaid), and it was treated at normal temperature for 20 minutes. After the treatment, this T-shirt was thoroughly rinsed with water, dehydrated, and allowed to dry to the full.

Next, using 80-mesh screen, Roman letters were printed on the breast of the T-shirt bulkily with the ink consisting of 20 parts of CHROMICOLOR S-27 pink (trade name, thermochromic microcapsules having 6 μm average particle diameter which contains a three-component mixture of acid developing substance, acidic substance and solvent, product of Matsui Shikiso Chemical Co., Ltd.) and 80 parts of MATSUMIN BINDER 350R (trade name, acrylic ester resin binder for printing, product of Matsui Shikiso Chemical Co., Ltd.). After the printing, the T-shirt was subjected to tumbler drying at 130° C. for 3 minutes.

The obtained T-shirt was found to be totally deep and bright yellow in the atmospheric temperature of 30° C. or more. When the atmospheric temperature dropped to 25° C. or less, orange Roman letters appeared. This change was reversibly repeatable.

The appearance, handling touch, color fastness to rubbing and color fastness to washing of the T-shirt excepting the area of Roman letters were all good. The quality of the area of Roman letters did not impair the commercial value of the T-shirt because the area was small.

EXAMPLE 6

A cotton T-shirt (grey sheeting, 120 parts) was washed and cationized in the same manner as in Example 1. subsequently, the T-shirt was thoroughly rinsed with water, and dehydrated.

Next, the T-shirt was immersed in the mixture liquid (aqueous dispersion liquid) of 2400 parts (bath ratio=20:1) of water, 6 parts of the aqueous dispersion liquid of daylight fluorescent yellow pigment as in used in Example 5, and 15 parts of CHROMICOLOR S-27 pink (aforesaid), and it was treated at 70° C. for 15 minutes. After the treatment, this T-shirt was thoroughly rinsed with water and dehydrated.

Next, the T-shirt was immersed in the mixture liquid of 2400 parts of water and 12 parts (solid content=-about 3.6 parts) of MATSUMINSOL MR-10 (aforesaid), and it was treated at 70° C. for 15 minutes. After the treatment, this T-shirt was thoroughly rinsed with water, dehydrated, and subjected to tumbler drying at 130° C. for 3 minutes.

The obtained T-shirt was found to be totally bright yellow in the atmospheric temperature of 30° C. or more. when the atmospheric temperature dropped to about 25° C. or less, the color of the T-shirt changed totally to bright and deep orange. This color changing was reversibly repeatable with the changes of the temperature.

The appearance, handling touch, color fastness to rubbing and color fastness to washing of the T-shirt were all good.

EXAMPLE 7

A cotton T-shirt was treated in the same manner as in Example 6 except that 15 parts of PHOTOPIA BLUE (trade name, photochromic microcapsules having 6 μm average particle diameter which contains organic photochromic compound, product of Matsui Shikiso Chemical Co., Ltd.) was used in place of CHROMICOLOR S-27 pink in Example 6.

The obtained T-shirt was found to be totally yellow under indoor conditions free of direct sun light, while it became bright and deep green at windows and outdoors under direct sun light. This color changing was reversibly repeatable in the presence or absence of light irradiation.

The appearance, handling touch, color fastness to rubbing and color fastness to washing of the T-shirt were all good.

EXAMPLE 8

A cotton T-shirt (grey sheeting, 120 parts) was washed, thoroughly rinsed with water, and dehydrated.

Next, the T-shirt was immersed in the aqueous solution consisting of 2400 parts (bath ratio=20:1) of water and 2 parts of polymer of 2-hydroxy-3-methacryloxypropyltrimethylammonium chloride (cationic compound), and it was treated at 60° C. for 15 minutes. After the treatment, this T-shirt was thoroughly rinsed with water and dehydrated.

Next, the T-shirt was immersed in the mixture liquid (aqueous dispersion liquid) of 2400 parts of water, 6 parts of the aqueous dispersion liquid of yellow pigment having 0.1 μm average particle diameter [20% of Benzidine Yellow, 1% of isobutylene/maleic anhydride copolymer, 4% of propylene glycol and 75% of water], 10 parts of CHROMIC COLOR S-27 pink (aforesaid), and 10 parts of PHOTOPIA BLUE (aforesaid), and it was treated at 70° C. for 15 minutes. After the treatment, this T-shirt was thoroughly rinsed with water and dehydrated.

Next, the T-shirt was immersed in the mixture liquid of 2400 parts of water and 12 parts (solid content=-about 3.6 parts) of MATSUMINSOL MR-10 (aforesaid), and it was treated at 70° C. for 15 minutes. After the treatment, this T-shirt was thoroughly rinsed with water, dehydrated, and subjected to tumbler drying at 130° C. for 3 minutes.

The obtained T-shirt was found to be totally bright yellow in the atmospheric temperature of 30° C. or more under indoor conditions free of direct sun light, while it became deep green at windows under direct sun light. When the atmospheric temperature dropped to 25° C. or less at windows under direct sun light, the color changed to deep black. Furthermore, interrupting the direct sun light, the color changed to deep orange. These color changings were reversibly repeatable with the changes of the temperature and in the presence or absence of light irradiation.

The appearance, handling touch, color fastness to rubbing and color fastness to washing of the T-shirt were all good.

COMPARATIVE EXAMPLES 4 THROUGH 11

The same procedures as in Examples 1 to 8 were followed excepting the cationizing treatments.

The respective products thus obtained were found to have no commercial value because their coloring densities were as low as about 10% in comparison with the clothes of Examples 1 to 8.

What is claimed is:

1. Pigmenting method comprising the steps of:

treating a cellulose fiber textile product with a nitrogenous cationic compound selected from the group consisting of quaternary ammonium salts, pyridinium salts, dicyandiamides, polyamines and poly-4-vinylpyridine hydrochloride, tertiary amine polymers, polymers of quaternary ammonium salts and copolymers of quaternary ammonium salts and vinyl monomers, in an aqueous treatment liquid for cationically treating the textile product, the cationic compound being capable of cationizing the cellulose fiber of the textile product and the treating being effected so that the cationic compound permeates the textile product and cationizes the cellulose fiber, and treating the thus-treated textile product by immersing it in an aqueous dispersion liquid containing fine particles of a pigment and an anionic compound selected from the group consisting of anionic surfactants and anionic polymer compounds, the anionic compound being capable of dispersing and anionizing the fine particles of the pigment so that the fine particles of the pigment are taken up essentially completely into the cationically treated textile product and bind thereto, thus pigmenting the textile product therewith, the textile product being cationically modified by the cationic compound to render the surface of the textile product receptive to adsorption and adherence of the fine particles of the pigment in the presence of the anionic compound.

2. Pigmenting method comprising the steps of treating a cellulose fiber textile product with a treatment liquid containing a nitrogenous cationic compound selected from the group consisting of quaternary ammonium salts, pyridinium salts, dicyandiamides, polyamines and poly-4-vinylpyridine hydrochloride, tertiary amine polymers, polymers of quaternary ammonium salts and copolymers of quaternary ammonium salts and vinyl monomers, for cationically treating the textile product, and treating the cationically treated textile product with an aqueous dispersion liquid containing a dispersion of a pigment dispersed with an anionic compound selected from the group consisting of anionic surfactants and anionic polymer compounds, for pigmenting the product with the pigment.

3. Method of claim 2 wherein the pigment is included in the dispersion liquid in a ratio of about 0.1 to 20% by weight relative to the textile product.

4. Method of claim 2 including treating the textile product with a resin binder for physically binding the pigment to the textile product.

5. Method of claim 4 wherein the resin binder is used in an amount of about 0.1 to 10% by weight binder solid content relative to the textile product.

6. Method of claim 4 wherein the textile product is treated with the resin binder after the textile product has been pigmented with the pigment.

7. Method of claim 6 wherein the resin binder is added to the residual dispersion liquid remaining after the textile product has been pigmented with the pigment, and the pigmented textile product is thereafter treated with the resin binder containing residual dispersion liquid.

8. Method of claim 6 wherein the resin binder is used in the form of a mixture thereof with water.

9. Method of claim 4 wherein the resin binder is added to the dispersion liquid before the textile product is pigmented with the pigment, and the textile product is thereafter treated with the resin binder and pigment containing dispersion liquid for pigmenting the product with the pigment and for binding the pigment to the textile product by the resin binder.

10. Method of claim 4 wherein the resin binder is added to the treatment liquid before the textile product is cationically treated with the cationic compound, and the textile product is thereafter treated with the resin binder and cationic compound containing treatment liquid for cationically treating the textile product and for binding the pigment to the textile product upon treating the textile product with the dispersion liquid for pigmenting the product.

11. Pigmented product made by the method of claim 2.

12. Pigmented product made by the method of claim 4.

13. Pigmented product made by the method of claim 6.

14. Pigmented product made by the method of claim 7.

15. Pigmented product made by the method of claim 8.

16. Pigmented product made by the method of claim 9.

17. Pigmented product made by the method of claim 10.

* * * * *